United States Patent [19]

Nathanson

[11] Patent Number: 5,011,598

[45] Date of Patent: Apr. 30, 1991

[54] DOMESTIC LEAD PURGING SYSTEM FOR TREATING STAGNATED WATER

[76] Inventor: Alan G. Nathanson, 15 Pettit Dr., Dix Hills, N.Y. 11746

[21] Appl. No.: 480,791

[22] Filed: Feb. 16, 1990

Related U.S. Application Data

[63] Continuation-in-part of Ser. No. 301,981, Jan. 26, 1989, abandoned.

[51] Int. Cl.[5] ..... E03B 7/04

[52] U.S. Cl. ..... 210/136; 137/337; 137/565; 210/912; 210/167

[58] Field of Search ..... 210/167, 96, 136, 137, 210/416.1, 912, 194, 97, 335, 499; 137/334, 335, 337, 359, 563, 565, 564; 4/192, DIG. 19; 72/41

[56] References Cited

U.S. PATENT DOCUMENTS

| | | | |
|---|---|---|---|
| 269,156 | 12/1882 | Campbell | 137/337 |
| 372,232 | 10/1887 | Newman | 137/564 |
| 1,108,550 | 8/1914 | Chubb | 137/564 |
| 2,255,460 | 9/1941 | Weaver | 137/564 |
| 2,758,610 | 8/1956 | Hively | 137/33 X |
| 4,351,678 | 9/1982 | Andrien et al. | 72/41 |
| 4,672,990 | 6/1987 | Robillard | 137/564 |
| 4,774,978 | 10/1988 | Lepine, Jr. et al. | 137/33 X |
| 4,789,475 | 12/1988 | Harte et al. | 210/912 |
| 4,898,678 | 2/1990 | Johnson et al. | 210/912 |

*Primary Examiner*—Robert A. Dawson
*Assistant Examiner*—Joseph Drodge
*Attorney, Agent, or Firm*—Michael I. Kroll

[57] ABSTRACT

A system for removing lead from a stagnated domestic hot and cold water system having fixtures and faucets is disclosed. Cold water pipes containing cold water are connected to the fixtures. Hot water pipes containing hot water is also connected to the fixtures. Crossover pipes fluidly connect the cold water pipes to the hot water pipes so that the cold water can enter the hot water pipes. Check valves assure that the cold water enters the hot water pipes and not visa-versa. A pump circulates the cold water and the hot water through the cold and hot water pipes when the faucets are closed so that a circulation system without the need for a third water line to create the circulation system is formed from the cold water pipes through the hot water pipes and resulting in a reverse flow loop through the hot and cold water pipes. A purifier removes sediment and numerous other water contaminants from the stagnated domestic hot and cold water system, including lead which has been leached into the hot water by stagnation, without having to flush the stagnated domestic hot and cold water system. Thus, eliminating the wasteful dumping of the stagnated hot and cold water.

3 Claims, 2 Drawing Sheets

DOMESTIC LEAD PURGING SYSTEM FOR TREATING STAGNATED WATER

BACKGROUND OF THE INVENTION

1. Cross Reference to Related Applications

The instant patent application is a continuation-in-part of copending patent application Ser. No. 301,981, filed 26 Jan. 1989 now abandoned.

2. Field of the Invention

The present invention relates to a lead purging system. More particularly, the present invention relates to a lead purging system utilizing circulation not stagnation to eliminate the need for flushing.

3. Description of the Prior Art

The Environmental Protection Agency (E.P.A.) has determined that lead is a health concern at certain levels of exposure.

Lead exposure from air, food, dust and drinking water can cause delayed physical and mental development in babies, impaired mental abilities in children, kidney damage, anemia, and hearing loss in children and adults. Even at low doses, contamination with the metal can cause interference with red blood cell formation, reduced birth weight, and premature birth.

Since lead accumulates in the body, the degree of harm depends upon the level of exposure from all sources.

It has been established that copper piping and fittings, joined with solder containing lead and lead base flux leaches excessive lead into the homes's potable water supply during six or (6) more hours of water stagnation in the piping.

The longer the water remains in the pipes, the greater the risk of lead being dissolved into the water.

This time frame was established when the E.P.A.'s maximum contaminant level (mcl), for lead was 0.050 parts per million (ppm). The (mcl) has since been lowered to 0.020 (ppm) which should effectively lower the water stagnation time frame.

The E.P.A. has recommended the flushing of stagnated water from the homes's plumbing water supply system, as set forth in the Safe Drinking Water Act. The use of flushing could become quite costly.

The pipe flushing durations have been estimated at five (5) to thirty (30) seconds where water has been used for showering or bathing, flushing toilets, or doing laundry with cold water, and several minutes to as much as "until the cold water gets as cold as it will get" where no water has been used for six (6) hours or more. In addition, it is recommended that only cold water should be used for drinking, cooking, or preparing baby formula.

The E.P.A. estimates that 53,000 public water supply systems, serving 138 million people, will have to put in programs to control corrosion, which would reduce the acidity of water and therefore its ability to pick up lead from pipes, mains, solder, and fittings.

The most common cause of lead in drinking water is corrosion, a reaction between the water and lead pipes or solder. Soft water (which lathers easily) tends to be more corrosive.

Corrosive water has a tendency to dissolve the metal it is in contact with. This will accelerate the leaching of lead into drinking water. However, even waters with relatively low corrosivity can cause lead to be dissolved, if the water is allowed to sit in the plumbing undisturbed for at least six hours.

Soldered pipes over five years old usually don't give off much lead because over time a film forms inside the pipes that separates the water from the metal.

Corrosion control programs can become tricky and have to be optimized for each water system.

Homes built before 1930 are more likely to have lead plumbing systems. Lead pipes are a dull grey color and scratch easily revealing a shiny surface.

Lead solder used to join copper pipes is a silver or grey color. If the house was built before January 1986, it's almost a certainty that it has lead-soldered joints.

Lead levels in drinking water are likely to be highest if the home or water system has lead pipes, if the home has copper pipes with lead solder, if the home is less than five years old, if there is soft or acidic water, or if water sits in the pipes for several hours.

New York State banned lead solder in plumbing as of Jan. 1, 1986.

Lead cannot be seen or tasted, the only way to tell if it's there is by testing.

Testing is especially important for apartment residents because flushing may not be effective in apartment buildings with lead soldered central piping.

Numerous liquid flow devices have been provided in the prior art, such as U.S. Pat. No. 2,758,610 to Hively and U.S. Pat. No. 4,672,990 to Robillard. While these units may be suitable for the particular purpose to which they address, they would not be as suitable for the purposes of the present invention as heretofore described.

SUMMARY OF THE INVENTION

Accordingly, it is an object of the present invention to provide a lead purging system which avoids the disadvantages of the prior art.

More particularly, it is an object of the present invention to provide a lead purging system that eradicates the stagnation of water in the domestic water supplies and thus, when combined with filtration or purification systems, virtually eliminates the need to flush the stagnated water. The elimination of water stagnation and circulation of the water in the domestic water supply system when filtered curtails the waste of water that results from flushing.

It has been proven in the laboratory, that lead forms on the interior of pipes housing stagnated water. By replacing the stagnated water with circulating water, the lead, sediment, and contaminants are purged out of the system without flushing.

In keeping with these objects, and with others which will become apparent hereinafter, one feature of the present invention resides, briefly stated, in a system for removing lead from a stagnated domestic hot and cold water system having a plurality of fixtures with a plurality of faucets, respectively, comprising, a plurality of cold water pipes containing cold water and connected to the plurality of fixtures, respectively, a plurality of hot water pipes containing hot water and connected to the plurality of fixtures, respectively, means for fluidly connecting the plurality of cold water pipes to the plurality of hot water pipes, respectively, so that the cold water can enter the plurality of hot water pipes, means for assuring that an entire flow volume of the cold water enters all of the plurality of hot water pipes and not visa-versa, means for circulating the cold water and the hot water through the plurality of cold and hot water pipes when the plurality of faucets are closed so that the circulation system carries the hot water and the cold water in a direction that is reverse to the direction of the hot and cold water supplies, without the need for a third water line to create the circulation system, is formed from the plurality of cold water pipes through the plurality of hot water pipes, respectively, and resulting in a reverse flow loop through the plurality of hot and cold water pipes, and means for removing sediment and numerous other water contaminants from the stagnated domestic hot and cold water system including lead which has been leached into the hot water by stagnation, without having to flush the stagnated domestic hot and cold water system and eliminate the wasteful dumping of the stagnated hot and cold water.

When the lead purging system is designed in accordance with the present invention, a circulation system without the need for a third water line to create the circulation system is formed from the cold water pipe through the hot water pipe. This results in a reverse flow loop through the hot and cold water pipes. Means are provided for removing sediment and numerous other water contaminants from the stagnated domestic hot and cold water system including lead which has been leached into the hot water by stagnation without having to flush the stagnated domestic hot and cold water system, and eliminate the wasteful dumping of the stagnated hot and cold water.

In accordance with another feature of the present invention, the connecting means include a plurality of crossover pipes.

Another feature of the present invention is that the assuring means include a plurality of check valves for assuring that the entire flow volume of the cold water enters all of the plurality of hot water pipes and not visa-versa.

Yet another feature of the present invention is that the circulating means include a circulation pump.

Still another feature of the present invention is that the circulation pump is a typical pump that could be a Teel Model IP760 circulating pump putting out 1/100 hp at 1500 rpm.

Yet still another feature of the present invention is that the removing means include a purifier, the purifier being a standard device containing activated charcoal, and filter screens of decreasing density, etc.

Still yet another feature of the present invention is that the plurality of check valves are disposed internal to the plurality of crossover pipes, respectively.

Another feature of the present invention is that it further comprises a water meter for activating the circulating pump.

Yet another feature of the present invention is that the plurality of crossover pipes and the plurality of check valves, respectively, are disposed at the plurality of faucet, respectively.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 1:
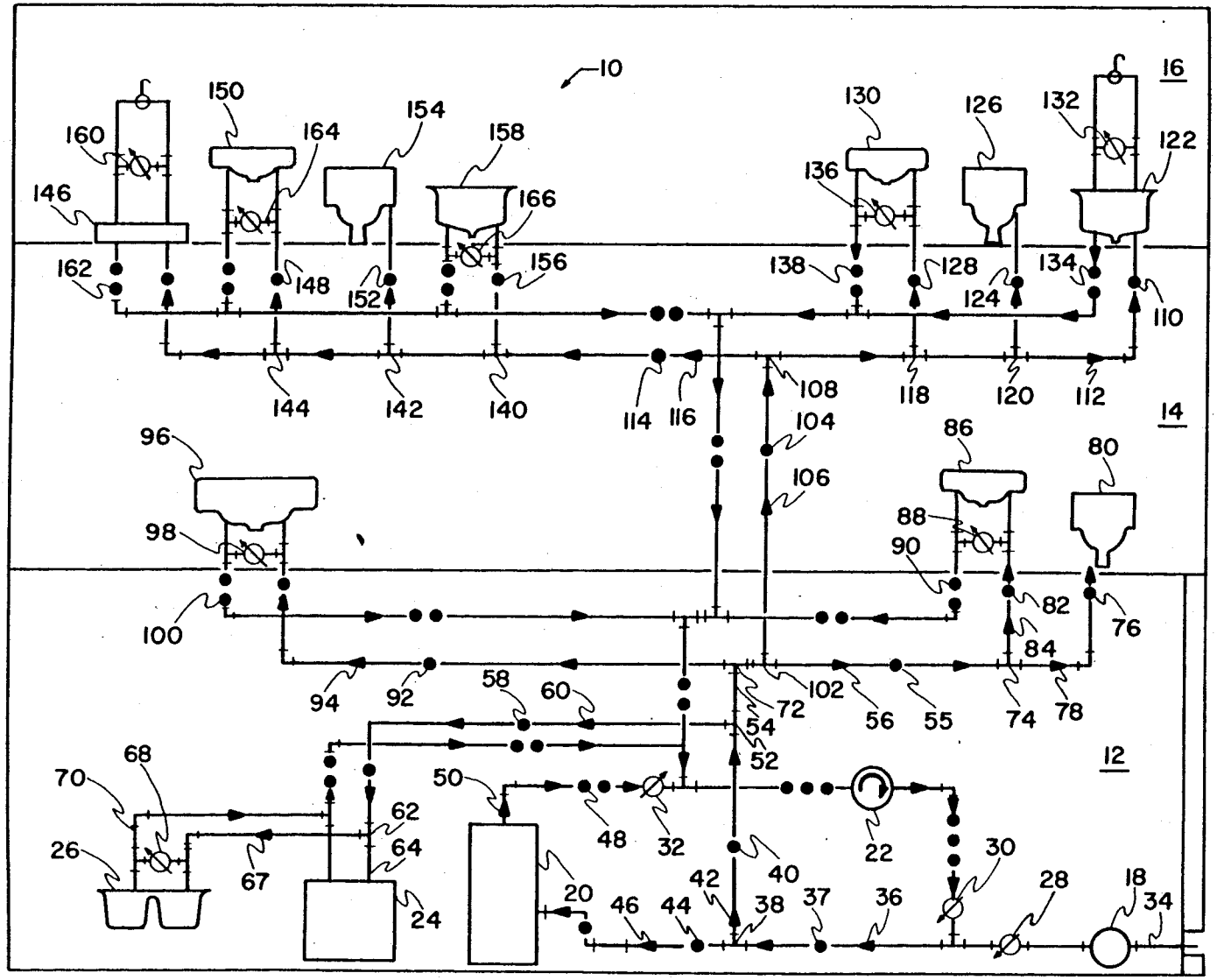
FIG. 1 is a schematic diagram of the lead purging system of the present invention being utilized in a residential home.

10—preferred embodiment of the present invention
12—basement
14—first floor
16—second floor
18—water meter or timer
20—hot water heater
22—circulation pump
24—washer
26—slop sink
28—check valve
30—check valve
32—check valve
34—point
36—arrow
37—cold water line
38—fork
40—cold water line
42—arrow
44—branch
46—arrow
48—hot water line
50—arrow
52—fork
54—right branch
55—right branch
56—arrow
58—left branch
60—arrow
62—fork
64—left branch
66—right branch
67—cold water line
68—check valve
70—hot water line
72—tee
74—fork
76—right branch
78—arrow
80—water closet
82—cold water line
84—arrow
86—lavatory
88—check valve
90—hot water line
92—left branch
93—cold water line
94—arrow
96—kitchen sink
98—check valve
100—hot water line
102—fork
104—left branch
106—arrow
108—tee 110—cold water line
112—arrow
114—cold water line
116—arrow
118—first fork
120—second fork
122—bathtub and shower
124—left branch
126—water closet
128—cold water line
130—lavatory
132—check valve
134—hot water line
136—check valve
138—hot water line
140—first fork
142—second fork
144—third fork
146—shower
148—right branch
150—lavatory
152—right branch
154—water closet
156—right branch
158—bathtub
160—check valve
162—hot water line
164—check valve
166—hot water line
10'—alternate embodiment of the present invention
12'—typical floor
22'—hot water circulation line
28'—check valve
36'—arrow
37'—cold water line
38'—fork
40'—cold water line
47'—arrow
48'—hot water line
52'—fork
54'—cold water line
56'—arrow
58'—cold water line
60'—arrow
80'—water closet
86'—lavatory
88' check valve
90' hot water line
91'—hot water circulation line
93'—hot water circulation line
96'—kitchen sink
158'—bathtub
160'—check valve
161'—check valve
162'—hot water line
163'—hot water circulation line
165'—hot water circulation line

DETAILED DESCRIPTION OF THE PREFERRED EMBODIMENTS

It has been proven in the laboratory, that lead forms on the interior of pipes housing stagnated water. By replacing the stagnated water with circulating water, the lead, sediment, and other contaminants are purged out without flushing the system.

The present invention is the creation of water circulation of the hot water through the cold water supply system throughout the home to provide constant contaminant free water at each faucet in the home.

Circulation of a home's water supply system requires a feed and return line. Since the majority of homes have and are still constructed with a cold water supply and hot water feed supply only, circulation can only be accomplished by tying or cross connecting the two (2) systems together.

The present invention crosses the cold water and hot water systems with the use of pipes, specific fittings, and check valves located at certain fixtures in the home. Furthermore, the present invention uses a circulation pump to create a reverse flow in either the cold or hot water feed line to form a "loop" effect, allowing the circulation of water throughout the home.

Installation of pipes, fittings, and check valve fittings, between the cold water and the hot water feed lines of the fixtures, for example, basins, showers, kitchen sinks, and laundry tubs, etc. result in the creation of a "loop" circulation system allowing the continuous flow of water throughout the "loop".

While the reverse flow "loop" effect can operate from the hot water supply to the cold water supply, or vise versa, the present invention recommends circulation from the cold water supply to the hot water supply by the use of check valves which may be upgraded as new equipment becomes available.

Thus, the installation of a third water line to create a circulation system is eliminated. This greatly reduces the cost to homeowners where circulation is wanted, and only cold water and hot water feeds are currently installed.

Installation of meters, timers, flow switches, solenoid valves, pressure reducing valves, lead filtering, or purification systems, etc. only enhance the present invention operation's. When properly maintained and used in conjunction with the present invention a properly conditioned pure water supply to the faucets result.

The present invention resolves the stagnated water problem in water supply piping and makes available at each faucet substantially contaminant free water without having to flush the system from the supply to the waste.

The Environmental Protection Agency has advised the public that leaching of lead in copper water piping with lead joints can be hazardous. Stagnated water in the piping for a duration of six hours or more may result in leaching of lead into the water system.

The following four paragraphs discuss standard off the shelf devices that are used for the removal of lead or other impurities and that are applicable for use in the present invention.

The flow of the present invention is generated by a circulation pump with water meter activation or manual means.

The entire circulation system returns the stagnated water to the house side of the water meter where it may pass through a water purifier and eliminate the wasteful dumping of water. Many types of apparatus for purification of water are available, including several types of larger filters for filtration of all water to domestic units as well as many types of smaller filters for adaptation to individual fixtures Also, other types of apparatus such as softeners or other types of ionexchange equipment also can remove contaminants, such as lead.

The water purifier of the present invention is a relatively standard device, possibly larger because of the application. It contains all of the standard components, such as activated charcoal, and filter screens of decreasing density, etc.

The filtering of the water through a purifier enables the removal of lead, sediment, and numerous other water contaminants which adversely affect the public.

Referring now to FIG. 1, the lead purging system of the present invention is shown generally at 10 as applied to a residential home having a basement 12, a first floor 14, and a second floor 16.

The basement 12 contains a water meter or timer 18 although not always necessary, hot water heater 20, circulation pump 22, or any other means to circulate the water, also, washer 24, and slop sink 26 ar present.

The water meter or timer 18 is of a standard off the shelf type. The water meter or timer 18 is disposed in the basement 12 on the main cold water supply line 34. The circulation pump 22 is the typical exceptable TEEL MODEL IP760 circulating pump (1/100 hp at 1500 rpm).

Check valve 28 controls the direction of flow of the incoming cold water. Check valve 30 controls the direction of flow of the circulating water, and check valve 32 controls the direction of flow of the hot water For the sake of simplicity, arrows are superimposed on the pipelines to indicate direction of water flow while a combination of dots (FIG. 1 only) indicate the type of water line. For instance, a single dot indicates a cold water line, a double dot indicates a hot water line, and a triple dot indicates circulation line of circulation pump 22.

The incoming cold water enters water meter or timer 18, at point 34. As the incoming cold water exits water meter or timer 18 it enters check valve 28. As the cold water leaves check valve 28, it flows in the direction of arrow 36 of cold water line 37, until it reaches fork 38. When the cold water in cold water line 37 reaches fork 38, it branches into cold water line 40, in the direction of arrow 42 and branch 44 in the direction of arrow 46. Branch 44 enters hot water heater 20. As the hot water leaves hot water heater 20, it enters hot water line 48 which is flowing in the direction of arrow 50. Check valve 32 assures that the hot water in hot water line 48 does not back up into hot water heater 20.

The cold water in cold water line 40 travels upward until it reaches fork 52. Right branch 54 enters tee 72 while left branch 58 travels in the direction of arrow 60. Left branch 58 flows in the direction of arrow 60 until it reaches fork 62 where left branch 64 of fork 62 enters washer 24 and right branch 66 approaches slop sink 26. Check valve 68 is located between cold water line 67 and hot water line 70. Check valve 68 allows flow from cold water line 67 to hot water line 70 when slop sink 26 is not being used.

Right branch 55 of tee 72 travels in the direction of arrow 56 until it reaches fork 74. Right branch 76 travels in the direction of arrow 78 and enters water closet 80. Cold water line 82 travels in direction of arrow 84 until it reaches lavatory 86. Check valve 88 is located between cold water line 82 and hot water line 90. Check valve 88 allows flow from cold water line 82 to hot water line 90 when lavatory 86 is not being used.

Left branch 92 of tee 72 travels in direction of arrow 94 and enters kitchen sink 96. Check valve 98 is located between cold water line 93 and hot water line 100. Check valve 98 allows flow from cold water line 93 to hot water line 100 when kitchen sink 96 is not being used.

Right branch 55 includes fork 102 that has left branch 104 traveling in the direction of arrow 106 and which brings cold water to second floor 16. Branch 104 contains tee 108 that has cold water line 110 traveling in the direction of arrow 112, and cold water line 114 traveling in the direction of arrow 116.

Cold water line 110 contains first fork 118 and second fork 120. Cold water line 110 of second fork 120 terminates at bathtub and shower space 122 while left branch 124 of second fork 120 terminates at water closet 126. Cold water line 128 of first fork 118 terminates at lavatory 130. Check valve 132 is located between cold water line 110 and hot water line 134 of bathtub and shower 122. Check valve 132 allows flow only from cold water line 110 to hot water line 134 when bathtub and shower 122 is not being used.

Check valve 136 is located between cold water line 128 and hot water line 138 of lavatory 130. Check valve 136 allows flow only from cold water line 128 to hot water line 138 when lavatory 130 is not being used.

Cold water line 114 of tee 108 contains first fork 140, second fork 142, and third fork 144. Cold water line 114 terminates at shower 146 while right branch 148 of fork 144 terminates at lavatory 150, right branch 152 of fork 142 terminates at water closet 154, and right branch 156 of fork 140 terminates at bathtub 158.

Check valve 160 is located between cold water line 114 and hot water line 162 of shower 146.

Another check valve 164 is located between cold water line 148 and hot water line 166 of bathtub 158.

As the cold water passes through the check valves into the hot water, while the fixtures are not being used, a reverse, flow is achieved that is circulated by a circulation pump 22.

Water properly and timely circulated by the installation of the present invention and compatible filtering or purification systems, virtually eliminate the need for flushing the potable water system caused by the stagnation of water.

The operation of home's, apartment building's, or high rise building's cold and hot water feed systems are not altered with the installation of the present invention.

The present invention, when used in the home is designed to operate when a no flow demand is available. When a no flow demand is available, the reverse flow "loop" circulation is activated by the circulation pump.

Either the cold water supply feed, or the hot water supply feed is circulated through the hot water cross connections, through a check valve and eliminates the stagnation of water in the plumbing piping system. Filtering or purifying the circulated water eliminates the need for flushing the water. This provides a means for the removal of lead or other impurities without having to flush the entire system.

Figure 2:
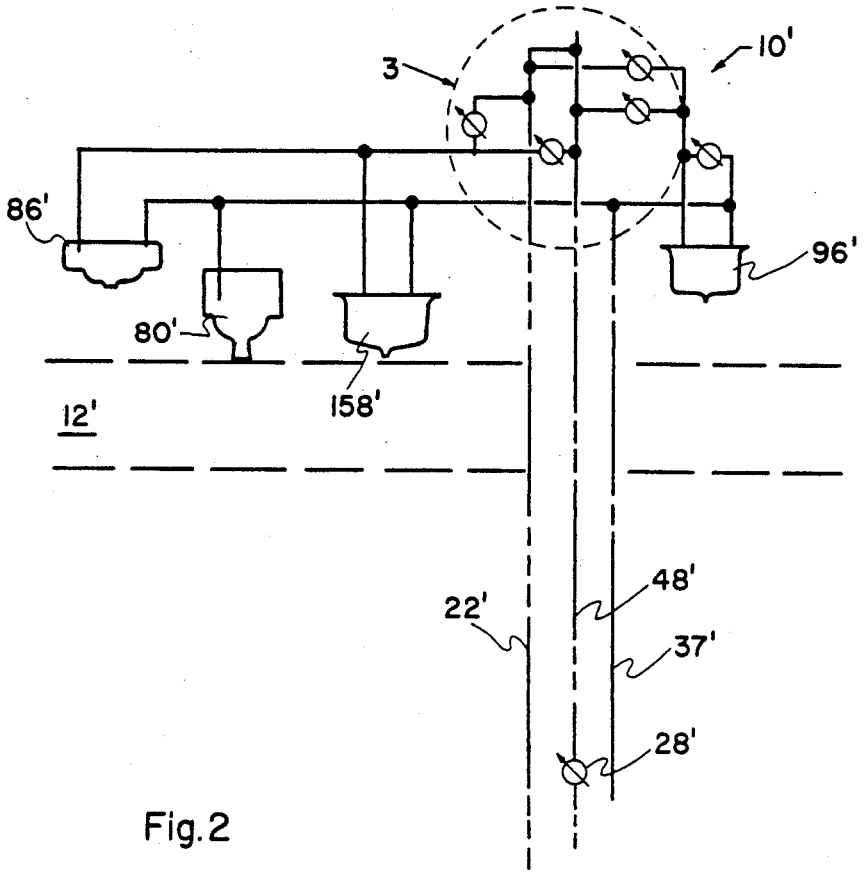
FIG. 2 is a schematic diagram of the lead purging system of the present invention being utilized in a high rise building.
Figure 3:
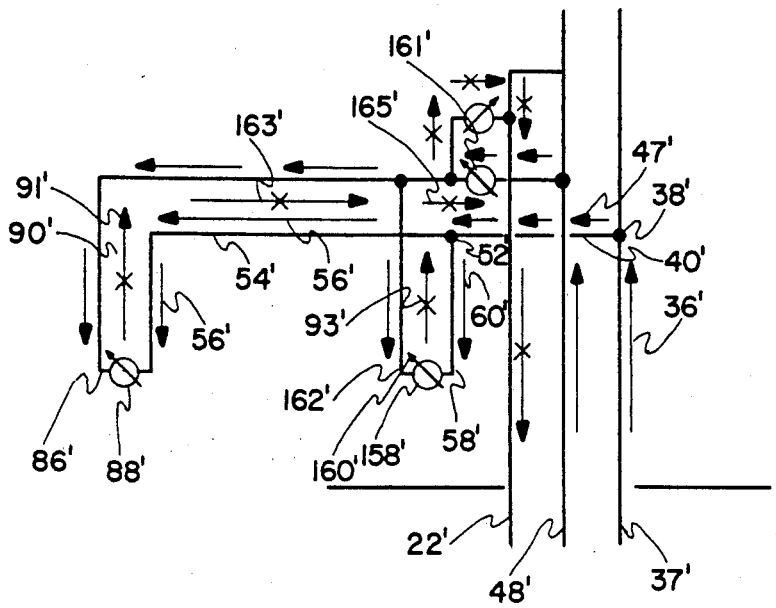
FIG. 3 is a partial schematic diagram of the lead purging system of the present invention taken at the area indicated by arrow 3 in FIG. 2.

Referring now to FIGS. 2 and 3, the present invention is shown generally at 10' as applied to a typical floor 12, of a high rise building.

Normally high rise structures have a three line water system consisting of a cold water, a hot water, and hot water circulation lines.

In high rise structures, the present invention works similar to the home unit by crossing the cold water feed and the hot water feeds with a check valve near the faucets.

When no water flow exists, the hot water system undergoes a reverse flow feeding to the hot water circulation system resulting in constant flow of the water, while reducing the chance of lead leaching.

Typical floor 12, contains lavatory 86', water closet 80', bathtub 158', and kitchen sink 96'.

Check valve 28' controls the direction of flow of the incoming hot water through hot water line 48' while the cold water enters through line 37'. Hot water circulating line 22' provides the reverse loop.

For the sake of simplicity, arrows are superimposed on the pipelines to indicate direction of water flow.

The cold water flows in the direction of arrow 36' of cold water line 37' until it reaches fork 38'. When the cold water reaches fork 38', it branches into cold water line 40' in the direction of arrow 47'. The cold water in cold water line 40' travels until it reaches fork 52'. Cold water line 58' travels in the direction of arrow 60' and enters bathtub 158'. Cold water line 54' flows in the direction of arrow 56' and enters lavatory 86'.

Check valve 88' is located between cold water line 54' and hot water line 90' of lavatory 86'. Check valve 88' allows flow from cold water line 54' to enter hot water line 90' which then enters hot water circulation line 91' when lavatory 86' is not being used.

Check valve 160' is located between cold water line 58' and hot water line 162' of bathtub 158'. Check valve 160' allows flow from cold water line 58' to hot water line 162' which then enters hot water circulation line 93' when bathtub 158' is not being used.

Check valve 161' is provided on hot water line 48' to prevent hot water from backing up into hot water heater.

Hot water circulation lines 91' and 93' enter hot water circulation line 22' via hot water circulation lines 163' and 165'.

It will be understood that each of the elements described above, or two or more together, may also find a useful application in other types of constructions differing from the type described above.

While the invention has been illustrated and described as embodied in a lead purging system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A system for removing lead from a stagnated domestic hot and cold water system having a plurality of fixtures with a plurality of faucets, respectively, comprising:

(a) a plurality of cold water pipes containing stagnated domestic cold water and connected to a plurality of fixtures, respectively, said stagnated domestic cold water being reuseable and not having to be wastefully dumped;

(b) a plurality of hot water pipes containing stagnated domestic hot water and connected to the plurality of fixtures, respectively, said stagnated domestic hot water being reuseable and never having to be wastefully dumped;

(c) means for fluidly connecting said plurality of cold water pipes to said plurality of hot water pipes, respectively, so that said cold water can enter said plurality of hot water pipes, said connecting means include a plurality of crossover pipes so that said cold water can enter said hot water, when said fixtures are turned off, and a reverse flush is required;

(d) means for assuring that said cold water enters all of said plurality of hot water pipes and said hot water does not enter any of said plurality of cold water pipes, said assuring means include a plurality of check valves for assuring that an entire flow volume of said cold water enters all of said plurality of hot water pipes and that none of an entire flow volume of said hot water enters any of said plurality of cold water pipes, said plurality of check valves being located inside said plurality of crossover pipes, respectively, said plurality of check valves assuring that said cold water flows in a direction when it enters said plurality of crossover pipes to mix with said hot water;

(e) a hot water heater and means for circulating said cold water and said hot water through said plurality of cold and hot water pipes when the plurality of faucets are closed so that the hot water and the cold water circulate in a reverse flow that assures that said hot water does not back up into the hot water heater, said circulating means including a circulation pump, said circulating pump circulating said cold water, as said cold water enters said hot water and achieving said reverse flow when said fixtures are not being used; and (f) means for removing sediment and numerous other water contaminants from said stagnated domestic hot and cold water system including lead which has been leached into said hot water by stagnation without having to flush the stagnated domestic hot and cold water, said sediment removing means being located such that all of said stagnated hot water and stagnated cold water passes through said sediment removal means and including a purifier, said purifier containing activated charcoal, and a plurality of filter screens wherein each successive filter of said plurality of filters contain a filter whose screen is lower in gauge than the previous screen so that the filtering becomes finer and finer.

2. A system as defined in claim 1; further comprising a water meter means for activating said circulating pump.

3. A system as defined in claim 2, wherein each of said plurality of crossover pipes and each of said plurality of check valves, respectively, are disposed at each of said plurality of faucets, respectively, said plurality of check valves assuring that said cold water flows in a direction when it enters said plurality of cross-over pipes to mix with said hot water during said reverse flow.

* * * * *